US006067815A

United States Patent [19]

James

[11] Patent Number: 6,067,815

[45] Date of Patent: May 30, 2000

[54] DUAL EVAPORATOR REFRIGERATION UNIT AND THERMAL ENERGY STORAGE UNIT THEREFORE

[75] Inventor: Timothy W. James, Santa Barbara, Calif.

[73] Assignee: TES Technology, Inc., Ventura, Calif.

[21] Appl. No.: 08/963,422

[22] Filed: Nov. 3, 1997

Related U.S. Application Data

[60] Provisional application No. 60/030,308, Nov. 5, 1996, and provisional application No. 60/047,064, May 17, 1997.

[51] Int. Cl.[7] ..... F25D 11/04

[52] U.S. Cl. ..... 62/438; 62/200; 165/10 A

[58] Field of Search ..... 62/434, 437, 430, 62/438, 439, 199, 200; 165/10, 10 A, 902

[56] References Cited

U.S. PATENT DOCUMENTS

| | | | |
|---|---|---|---|
| 2,641,109 | 6/1953 | Muffly | 62/199 |
| 2,763,132 | 9/1956 | Jue | 62/200 X |
| 4,122,892 | 10/1978 | Delaporte | 165/12 |
| 4,220,196 | 9/1980 | Gawron et al. | 165/11 R |
| 4,341,262 | 7/1982 | Alspaugh | 165/10 A |
| 4,439,998 | 4/1984 | Horvay et al. | 62/199 |
| 4,655,050 | 4/1987 | Aschberger et al. | 62/200 |
| 4,712,387 | 12/1987 | James et al. | 62/434 |
| 4,756,164 | 7/1988 | James et al. | 62/119 |
| 4,760,707 | 8/1988 | Dennis et al. | 62/199 X |
| 4,928,493 | 5/1990 | Gilbertson et al. | 62/437 X |
| 5,105,632 | 4/1992 | Naruse | 62/352 |
| 5,239,839 | 8/1993 | James | 62/434 |
| 5,465,591 | 11/1995 | Cur et al. | 62/439 |
| 5,524,453 | 6/1996 | James | 62/434 |

FOREIGN PATENT DOCUMENTS

| | | | |
|---|---|---|---|
| 60-175996 | 9/1985 | Japan | 165/10 A |

OTHER PUBLICATIONS

"The Cold", Joe Minick, *Cruising World*, pp. 54–62 (Jun. 1995).

*Primary Examiner*—Harry B. Tanner
*Attorney, Agent, or Firm*—Blakely, Sokoloff, Taylor & Zafman LLP

[57] ABSTRACT

A low-cost and thermodynamically efficient implementation of a two-stage refrigeration system applied to a retail refrigerator. The invention includes a simple and easily manufactured thermally efficient and low-cost evaporation unit. The invention further includes a thermal energy storage module and an energy efficient control protocol to maintain steady temperatures in the fresh and frozen food sections, to permit energy efficient defrosting of the heat exchange surfaces in the freezer section, and minimize losses associated with condensing unit on-and-off cycling.

24 Claims, 9 Drawing Sheets

DUAL EVAPORATOR REFRIGERATION UNIT AND THERMAL ENERGY STORAGE UNIT THEREFORE

This is a non-provisional United States (U.S.) patent application based on two provisional U.S. patent applications including (i) a first provisional U.S. patent application entitled "Cost and Energy Efficient Implementation of a Dual Evaporator Refrigerator Using Thermal Energy Storage" (App. No. 60/030,308; Attorney Docket No. 096261.P001Z) filed Nov. 5, 1996 and (ii) a second provisional U.S. patent application entitled "Cost and Energy Efficient Implementation of a Dual Evaporator Refrigerator Using Thermal Energy Storage" (App. No. 60/047,064; Attorney Docket No. 096261.P001Z2) filed May 17, 1997.

BACKGROUND OF THE INVENTION

1. Field of the Invention

The present invention relates to the field of refrigeration. More particularly, one embodiment of the present invention relates to a two-stage refrigeration system utilizing an evaporator integrated with an encapsulated thermal energy storage module.

2. Background of Art Related to the Invention

For many decades, domestic refrigerators have included a freezer section and a fresh food section. The fresh food section is maintained at a significantly higher temperature than the freezer section. While the basic laws of thermodynamics provide empirical evidence that it is increasingly more difficult to cool (i.e., remove heat from) an item as its temperature decreases, domestic refrigerators typically have been designed with more consideration focused on cost than thermodynamics. For example, many domestic refrigerators use a one-stage refrigeration system including a single evaporator located in the freezer section. Since the total heat load dissipation is through this single evaporator, this one-stage refrigeration system possesses less than optimal energy efficiency.

Recently, in order to increase system efficiency, some refrigerators have been constructed with two separate refrigeration systems; namely, one refrigeration system is responsible for cooling the freezer section while the other refrigeration system is responsible for cooling the fresh food section. Consequently, this dual refrigeration system includes repetitive condensing units, each featuring a compressor and a condenser. This repetition of equipment increases the cost and size of the refrigerator. Also, these repetitive condensing units produce a greater amount of noise.

Another example involves yacht refrigerators which have been implemented with refrigeration systems having valves to sequentially, but not simultaneously, connect a single, high-capacity condensing unit to multiple evaporators operating at differing temperatures. The refrigeration system may use thermal energy storage (TES) material to provide stable temperatures during the period between evaporator operations.

Preferably, TES material is an aqueous solution such as a salt solution having water and sodium chloride (NaCl). This composition provides high heat storage capacity, emits a large amount of heat isothermally upon changing phase from a liquid to a solid, is non-toxic and can be produced for a low cost. Unfortunately, this TES material is highly corrosive to most metals, tends to expand when frozen which would damage the thin wall of the heat exchanger and tends to freeze first on the heat exchange surfaces which would hamper further heat transfer. This requires the TES material to be separated from the thin-walled metal tubing of the heat exchanger. One technique of separation involves encapsulating TES material into separate expandable capsules as described in U.S. Pat. No. 5,239,839 by the named inventor. However, such encapsulation is costly and difficult to produce.

Additionally, the use of TES material adversely affects the efficiency of conventional defrosting cycles. The reason is that conventional defrost methods, if implemented, would require the entire TES material to melt before actual defrosting could begin.

U.S. Pat. Nos. 4,712,387 and 4,756,164 by the named inventor describe a heat pipe based method for efficiently transferring heat into and out of TES material and a method for thermally de-coupling the TES material from the cooled space to enable simple and efficient defrosting of the evaporator. These methods fail to provide any suggestion of the multi-stage refrigeration system and/or control protocol used to control this refrigeration system.

In contrast to the prior techniques and refrigeration systems, the present application describes a cost-effective evaporation unit and an energy efficient control protocol to maintain steady temperatures for each section of a refrigeration unit. An additional element of this disclosure is the use and design of a simple sensor for determining the frozen fraction of a TES module in order to control on-and-off cycling of the compressor for temperature stabilization.

SUMMARY OF THE INVENTION

The present invention describes a low-cost and thermodynamically efficient implementation of a multi-stage refrigeration system utilized by a refrigeration unit such as a retail refrigerator. This multi-stage refrigeration system includes a condensing unit and at least two evaporation units connected to the condensing unit through tubing and a plurality of valves. These valves may include a pair of selector valves, four check valves or any combination or type of valves necessary to control liquid and vapor flow through the refrigeration system.

The present invention further features a simple and easily manufactured thermally efficient and low-cost evaporation unit, a thermal energy storage module of the evaporation unit and an energy efficient control protocol to maintain steady temperatures of a freezer and fresh food section of the refrigeration unit. This control protocol permits energy efficient defrosting of the heat exchange surfaces in the freezer section and minimize losses associated with condensing unit on-and-off cycling.

BRIEF DESCRIPTION OF THE DRAWINGS

The features and advantages of the present invention will become apparent from the following description of the present invention in which.

DESCRIPTION OF THE PREFERRED EMBODIMENT

The present invention relates to a thermodynamically efficient multi-stage refrigeration system, a thermal energy storage module and its corresponding method of operation. In the following detailed description, specific details are set forth for illustration purposes in order to ensure understanding of the present invention. Of course, it would be apparent to one skilled in the art that the present invention may be practiced while still deviating from these specific details. Furthermore, it should borne in mind that the present invention should not be limited solely in connection with refrigerators, but may be utilized for other type of appliances.

In the following description, some terminology is used to generally describe certain features of the refrigeration system. For example, a "refrigeration unit" may include a refrigerator, a stand-alone freezer, an air conditioner, cryogenic equipment or any other equipment that provides refrigeration. A "refrigerant" may include any refrigerant such as those used domestically as well as in foreign countries like Europe. A "tube" (and related tenses such as "tubing") is defined as a partially enclosed region which is capable of transferring material in various forms from a source to a destination. The tube may be constructed of any non-soluble material such as metal or plastic.

1. Multi-Stage Refrigeration System

Figure 1:
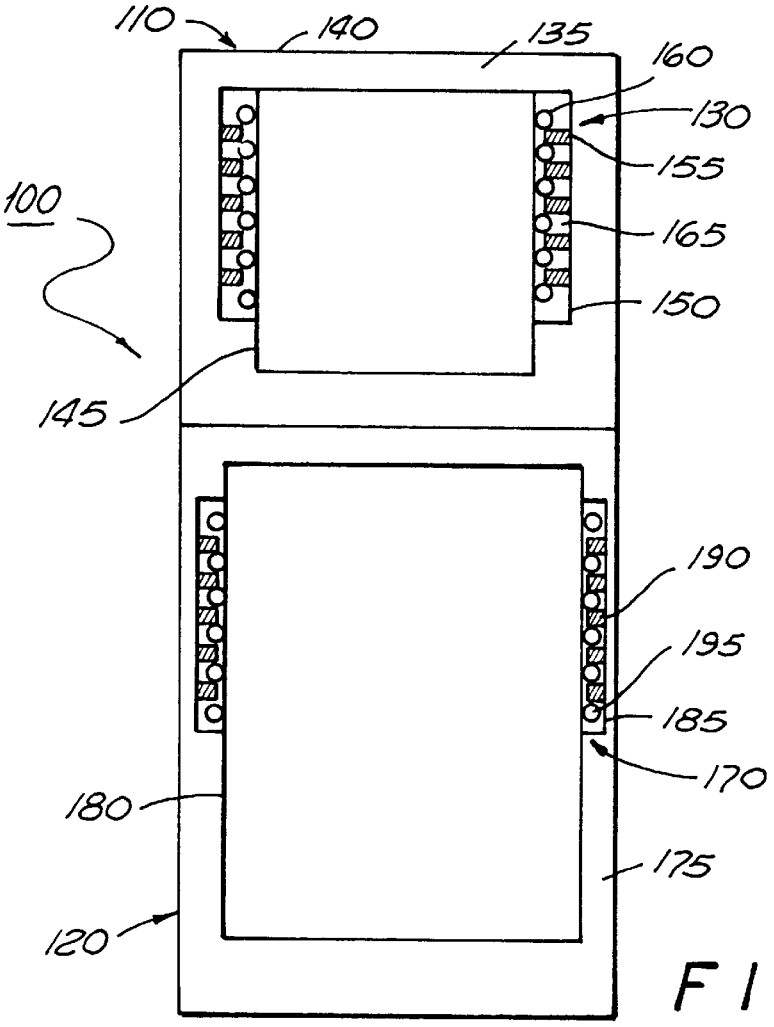
FIG. 1 is an illustrative embodiment of a refrigeration unit implemented with the present invention.

Referring to FIG. 1, an illustrative embodiment of a refrigeration unit (e.g., refrigerator) implemented with a multi-stage refrigeration system is shown. Refrigeration unit 100 includes a first section 110 and a second section 120. In this embodiment, the first section 110 is a freezer which is maintained at a lower temperature than the temperature of the second (fresh food) section 120. It is contemplated, however, that these sections 110 and 120 may be maintained at generally equivalent temperatures.

The first section 110 includes a first evaporation unit 130 placed adjacent to (i) insulation 135 surrounded by an outer wall 140 of the first section 110, and (ii) a liner 145 creating a compartment for item storage. As described above, first evaporation unit 130 includes the containment vessel 150 including TES module 155 having one or more protrusions spaced between segments of an evaporation tube 160. The containment vessel 150 is filled with freely convecting thermal coupling solution 165 (not shown). The thermal coupling solution is any liquid supporting freely convecting heat transfer such as an alcohol and water composition. Other characteristics of the thermal coupling solution may include, but are not limited or restricted to low viscosity, low cost and low toxicity. First evaporation unit 130 may be constructed to be adjacent to multiple sides of the first section as shown or a single side.

Similarly, second section 120 includes a second evaporation unit 170 placed adjacent to both insulation 175 and a liner 180 creating another compartment. The second evaporation unit 170 includes a containment vessel 185 enclosing TES module 190 having protrusions spaced between segments of its evaporation tube 195. The containment vessel 185 is also filled with freely convecting thermal coupling solution (not shown).

Figure 2:
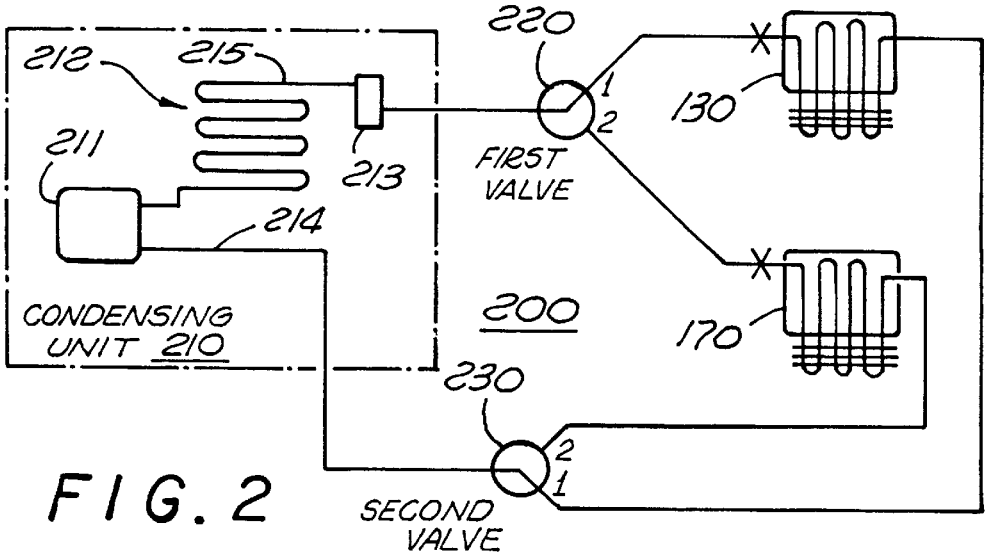
FIG. 2 is an illustrative embodiment of a multi-stage refrigeration system utilizing selector valves.

Referring to FIG. 2, one embodiment of a thermodynamically efficient, multi-stage refrigeration system 200 utilized by refrigeration unit 100 is shown. This embodiment of multi-stage refrigeration system 200 includes a condensing unit 210, a first valve 220, at least two evaporation units 130 and 170 and a second valve 230. As further described below, each evaporation unit 130 and 170 includes an evaporator integrated with one or more expandable container(s) filled with thermal energy storage "TES" material such as an aqueous solution such as water and sodium chloride (NaCl). Other types of aqueous solutions may include, for example, different combinations of alkali metals (Group 1a) or alkaline earth elements (Group 2a) with halogen elements (Group 7a). Of course, a variety of non-aqueous solutions may be used as TES material. Each expandable container may be referred to as a "TES module".

The collective, simultaneous operations of valves 220 and 230 place refrigeration system 200 in one of two modes of operation. In general, the first mode of operation is a regular cycle where the TES module of the evaporation units 130 and 170 are sufficiently frozen to maintain the first and second sections 110 and 120 generally at their targeted temperatures. The second mode of operation is a defrost cycle in which the refrigerant from first evaporation unit 130 is removed in order to melt frozen water from the heat exchange surface of the first evaporation unit 130. The particular state (or setting) of these valves 220 and 230 during these regular and defrost cycles are shown in Tables 2 and 3 and are described below.

Referring still to FIG. 2, condensing unit 210 includes a compressor 211, a condenser 212 and a reservoir 213 interconnected by tubes 214 and 215. During operation, compressor 211 receives refrigerant as vapor from second valve 230 via tube 214 and compresses the vapor refrigerant to a selected pressure. Next, condenser 212 cools the compressed, refrigerant vapor to produce a liquid refrigerant which is subsequently supplied to reservoir 213 through tube 215. The throughput of the liquid refrigerant is controlled by first valve 220 as well as an expansion device which is normally situated at an inlet of each evaporation unit 130 and 170. The expansion device X may include a capillary tube or any mechanical device used to control flow rate between two areas having different levels of pressure such as an expansion valve well-known in the art.

The first valve 220 is a liquid selector valve that regulates the flow of liquid refrigerant from reservoir 213 into either first evaporation unit 130 or second evaporation unit 170. As shown, first valve 220 selects a flow path to first evaporation unit 130 when placed in a first setting (outlet 1-on; outlet 2-off) and selects a flow path to second evaporation unit 170 when placed in a second setting (outlet 1-off; outlet 2-on). The flow of liquid refrigerant through valve 220 is automatically changed by adjusting the setting of valve 220 in accordance with the control protocol described below. It is contemplated, however, that the valves 220 and 230 may be construed with additional settings in which the flow path is disconnected from either of the evaporation units. In this case, for example, the control protocol may be slightly altered to possibly select that setting when the compressor is turned off.

Figure 3:
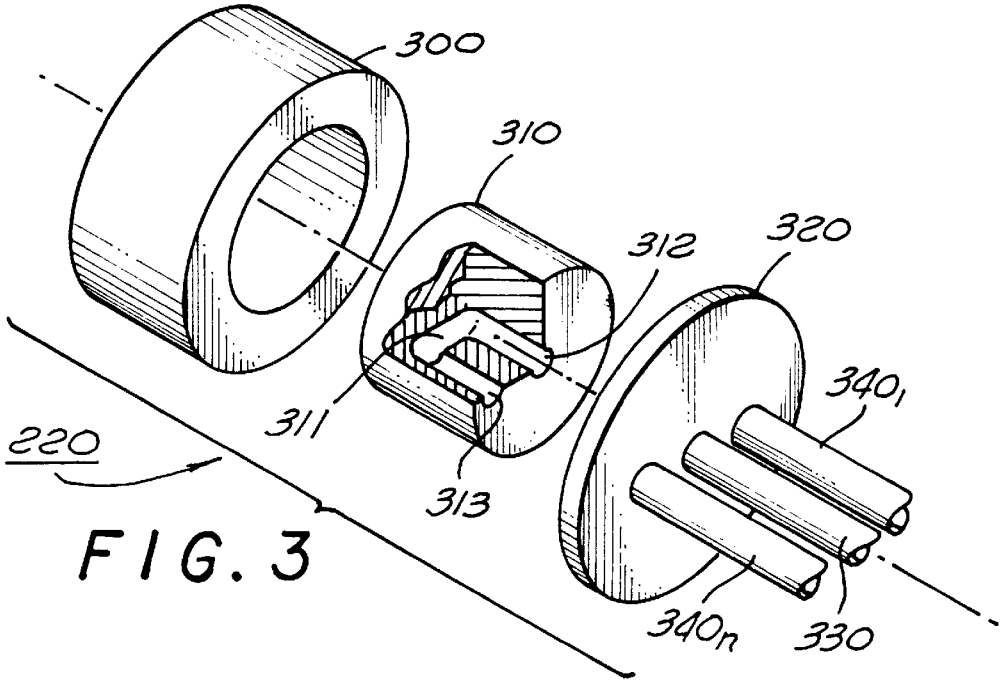
FIG. 3 is an illustrative embodiment of a selector valve of the refrigeration system of FIG. 2.

One embodiment of first valve 220 features an electromagnetic selector valve such as a rotary face seal valve as shown in FIG. 3. This valve includes a housing and rotary actuator 300, a rotary valve element 310 and a stationary base plate 320 supporting a single inlet 330 and one or more outlets $\mathbf{340}_1$–$\mathbf{340}_n$ ("n" is a positive whole number). Rotary valve element 310 features an internal flow passage 311 including an input 312 and a single output 313. Input 312 is always in alignment with inlet 330. However, output 313 may be aligned with output $\mathbf{340}_1$ or output $\mathbf{340}_n$ based on the rotational orientation of rotary valve element 310. This orientation is selected through rotational adjustment of housing and rotary actuator 300 in which one flow path is selected when actuator 300 is energized and the other flow path is selected when actuator 300 is not energized.

Referring back to FIG. 2, second valve 230 may be implemented as a suction selector valve that selects to receive refrigerant vapor from either first evaporation unit 130 or second evaporation unit 170. As shown, second valve 230 selects a flow path from first evaporation unit 130 when placed in a first setting (inlet 1-on; inlet 2-off) and selects a flow path from second evaporation unit 170 when placed in a second setting (inlet 1-off; inlet 2-on). The selected construction of second valve 230 may be similar to the embodiment described for first valve 220 with exception in substitution of a single outlet and multiple inlets. Of course, other embodiments for these valves may be utilized (e.g., mechanical, electrical, magnetic and/or electro-magnetically controlled valves) besides those illustrated.

Figure 4A:
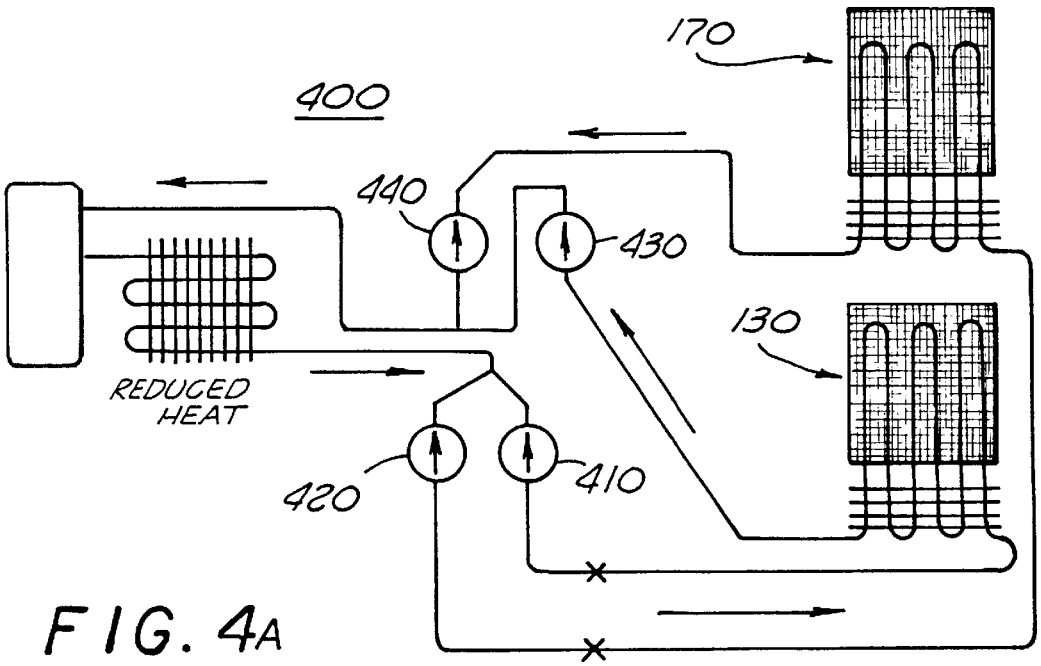
FIG. 4A is another illustrative embodiment of a multi-stage refrigeration system utilizing check valves.

Referring to FIG. 4A, another embodiment of a thermodynamically efficient, multi-stage refrigeration system 400 utilized by refrigeration 100 unit is shown. Similar to the embodiment shown in FIG. 2, multi-stage refrigeration system 400 includes a condensing unit 210, a plurality of check valves 410, 420, 430 and 440 and at least two evaporation units 130 and 170 as described below. Each evaporation unit 130 and 170 includes an evaporator integrated with one or more TES modules.

The collective, simultaneous operations of valves 410, 420, 430 and 440 place refrigeration system 400 in one of three modes of operation. In general, the first mode of operation (Mode A) is where a first valve 410 and a third valve 430 are functioning as normal check valves while a second valve 420 and a fourth valve 440 are "overridden" such that they do not impede liquid or vapor flow in either direction. The second mode of operation (Mode B) is where the first and third valves 410 and 430 are overridden while second and fourth valves 420 and 440 are functioning as normal check valves. The third mode of operation (Mode C) is where all of the check valves function as normal one-way check valves which provides a defrost capability. The check valve operation protocol to support the above-described operations are set forth in Table 1.

TABLE 1

State of Valves/Compressor of the Refrigeration System of FIG. 4A

| Sequence | Valve 1 | Valve 2 | Valve 3 | Valve 4 | Compressor | Mode |
|---|---|---|---|---|---|---|
| Start | check⇒ | open⇔ | check⇒ | open⇔ | On | A |
| Low Temp Run (TES Freezing) | open⇔ | check⇒ | open⇔ | check⇒ | On | B |
| High Temp Run (TES Freezing) | check⇒ | open⇔ | check⇒ | open⇔ | On | A |
| Passive Cooling (TES melting) | check⇒ | check⇒ | check⇒ | check⇒ | Off | C |
| Defrost: Low Temp Liquid Removal | check⇒ | check⇒ | check⇒ (passes flow) | check⇒ | On, briefly | C |
| Defrost | check⇒ | check⇒ | check⇒ | check⇒ | Off | C |

Figure 4B:
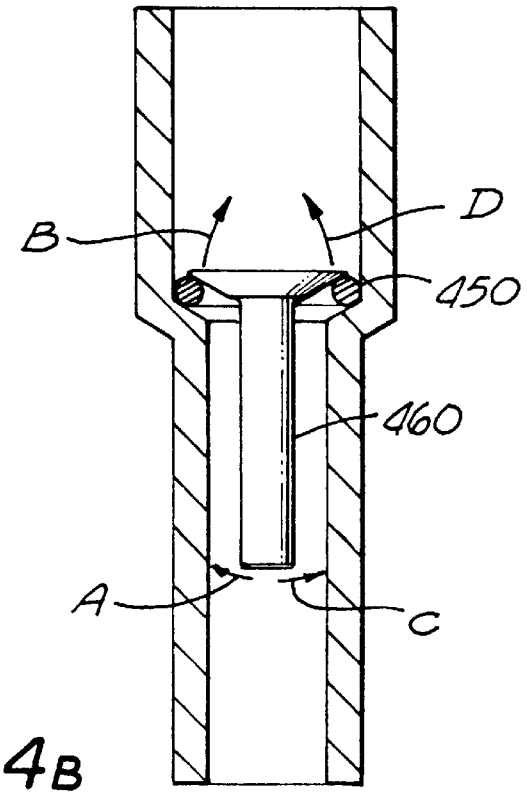
FIG. 4B is an illustrative embodiment of a check valve of the refrigeration system of FIG. 4A.

Each of the check valves 410, 420, 430 or 440 may be constructed with any check valve embodiment such as a tilt-type check valve as shown in FIG. 4B. The tilt-type check valve includes an o-ring valve seat 450 and a valve stem 460 placed in tubing. Made of magnetic material, valve stem 460 is attached to o-ring valve seat 450. Normally, valve stem 460 is applying a force against o-ring valve seat 450 caused by gravity or possibly by a mechanical element (e.g., spring). This provides sufficient closure of the o-ring valve seat 450.

When an external magnetic field is applied, the normal check valve action of valve stem 460 can be overridden by magnetically repositioning valve stem 460 as shown by arrows A and B or arrows C and D. This small amount of lateral and/or vertical movement by valve stem 460 opens the valve. Both lateral and vertical movement of valve stem 460 may allow the valve to be opened easier by mitigating back pressure associated with tube. The external magnetic field may be applied by an external electromagnet or even a permanent magnet positioned by any mechanical means in order to override one or more check valves.

Figure 4C:
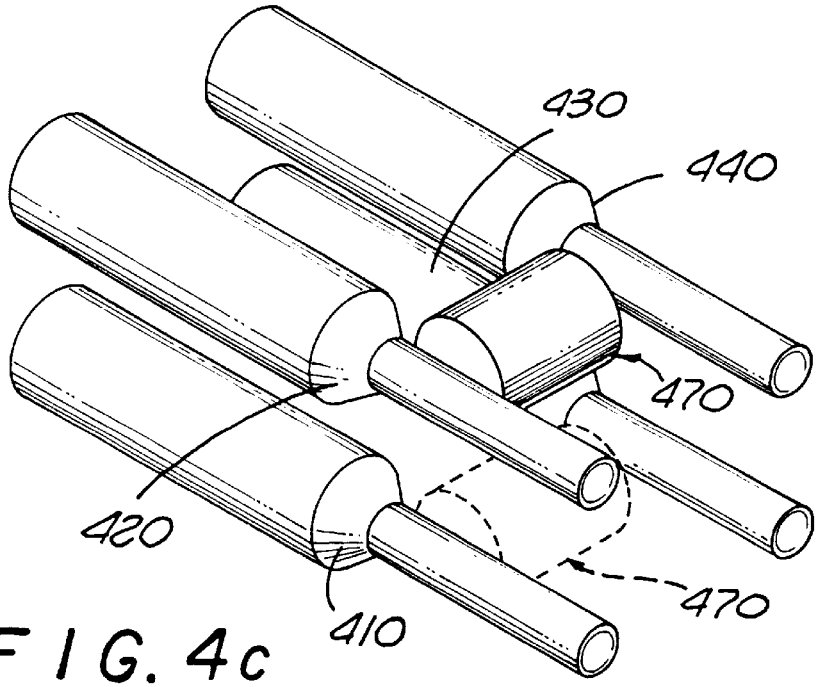
FIG. 4C is an illustrative embodiment of a plurality of check valves whose operation is controlled by an external magnetic field.

As an illustrative example, FIG. 4C shows a condition where a magnet 470 is placed in a first position which overrides the second and fourth check valves 420 and 440 while allowing the first and third check valves 410 and 430 to operate as normal. This condition usually occurs at the start a regular cycle and in freezing TES material associated with the second (higher temperature) evaporation unit. FIG. 4C also shows another condition where the magnet 470 is placed in a second position (denoted by dotted lines) which overrides the first and third check valves 410 and 430 while the second and fourth check valves 420 and 440 function as normal.

Figure 5:
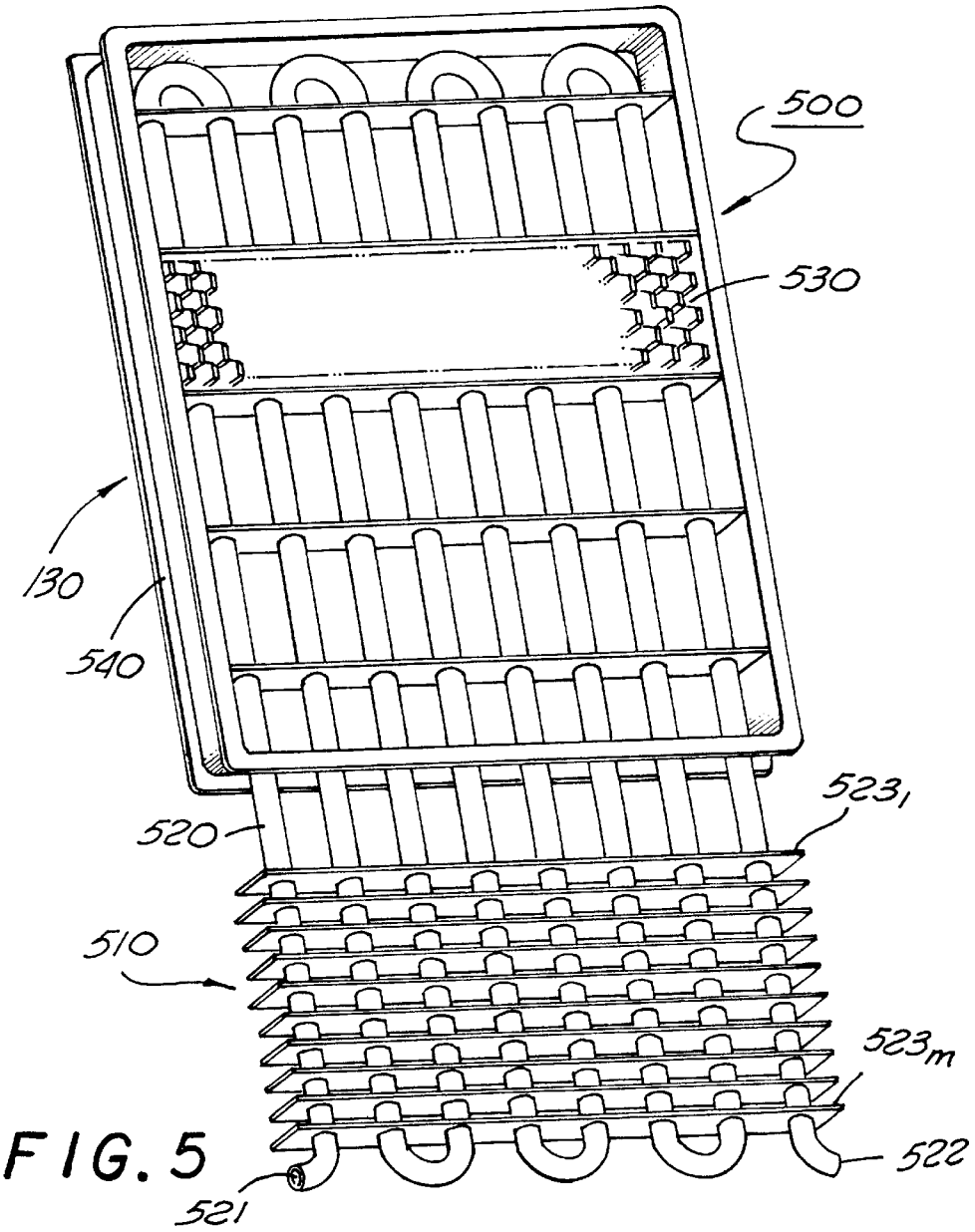
FIG. 5 is an illustrative embodiment of an evaporation unit implemented in refrigeration systems of FIGS. 2 and 4A.

Referring now to FIG. 5, an embodiment of an evaporation unit (e.g., the first evaporation unit 130) is shown. Of course, the second evaporation unit 170 possess a similar (if not identical) implementation. The first evaporation unit 130 includes an evaporator featuring an upper heat exchanger 500 and a lower heat exchanger 510, both of which are formed by segments from a single evaporation tube 520. Shaped in a serpentine pattern or bent and manipulated in any direction so that liquid refrigerant will flow freely, evaporation tube 520 also operates as heat pipes to transfer heat to a TES module 530 described below. The lower heat exchanger 510 features a plurality of U-shaped segments of evaporation tube 520 including an inlet 521 to receive liquid refrigerant and at least one outlet 522 to output refrigerant vapor. The lower heat exchanger 510 further features a plurality of evaporator fins $\mathbf{523}_1$–$\mathbf{523}_m$ ("m" is a positive whole number) placed adjacent to evaporation tube 520 for enhanced heat transfer from air to the refrigerant.

The TES module 530 is placed adjacent to segments of evaporation tube 520 located in upper heat exchanger 500. Both TES module 530 and upper heat exchanger 500 are collectively enclosed in a containment vessel 540 filled with thermal coupling solution (not shown). There are several options for sealing the penetrations of segments of evaporation tube 520 into containment vessel 540. A foamed sealant can provide both the required sealing and provide insulation for evaporation tube 520. This will help prevent ice build-up on a portion of evaporation tube 520 adjacent to containment vessel 540 and minimize the heating required for defrosting lower heat exchanger 510.

The "TES module" 530 is TES material encapsulated within an expandable container to avoid direct contact (physical or chemical) with evaporation tube 520 in upper heat exchanger 500. The "thermal coupling solution" is an liquid that does not freeze at normal operating temperatures of the refrigeration unit and provides thermal coupling between TES module 530 and upper heat exchanger 500.

Figure 6:
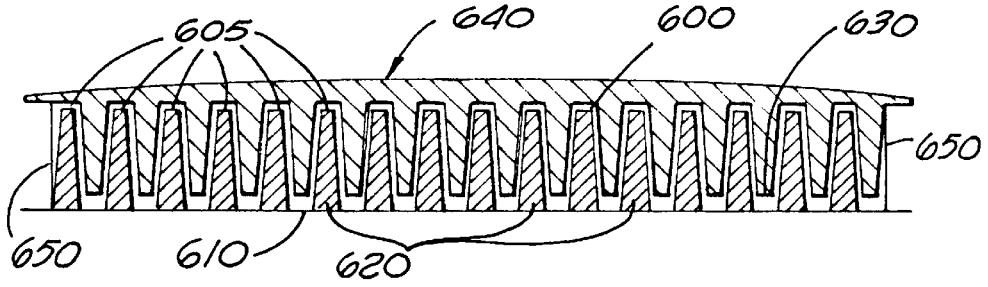
FIG. 6 is an illustrative embodiment of a thermal energy storage (TES) module implemented within the evaporation unit of FIG. 5.

In one embodiment, TES module 530 is formed by two sheets of material 600 and 610 such as thermal formed plastic as generally shown in FIG. 6. A first sheet 600 includes an array of closely spaced, high aspect ratio protrusions 605 which form cavities for TES material; namely, some of these protrusions 605 have a substantial amount of surface area situated adjacent to segments of evaporation tube associated with upper heat exchanger in order to remove heat from refrigerant passing therethrough. These protrusions 605 are tapered to simplify their manufacture and to ensure that ice blocks do not cause localized pressure. If freezing occurs so that a region of liquid TES material remains trapped in the end of a protrusion, the tapered shape permits the ice plug to relieve pressure generated when the remaining liquid freezes.

A backing sheet 610, which is normally flat, is sealed to first sheet 600 around its perimeter in order to form an enclosed area 620. The enclosed area 620 is filled with TES material. Alternatively, backing sheet 610 may be sealed around the base of each protrusion. The sealing may be accomplished through heat or ultrasonic welding to prevent leakage. It is contemplated, however, that backing sheet 610 may be patterned in a manner similar to first sheet 600 and sealed to first sheet 600 so that the protrusions of both sheets protrude outward.

It is contemplated that TES module 530 may further include a second pair of sheets 630 and 640 which are constructed in a similar manner in order to substantially occupy a substantial amount of the volume of containment vessel 540. The second pair of sheets 630 and 640 are constructed to interlock with the first pair of sheets 600 and 610 and with the protrusions generally perpendicular to the evaporation tube and parallel to the fins, but leaving well-defined passages for the thermal coupling solution to flow between sheets 600 and 630. U-shaped flanges 650 of containment vessel 540 are sealed to sheets 600 and 610 to form one side of the containment vessel for the thermal coupling solution.

Figure 7A:
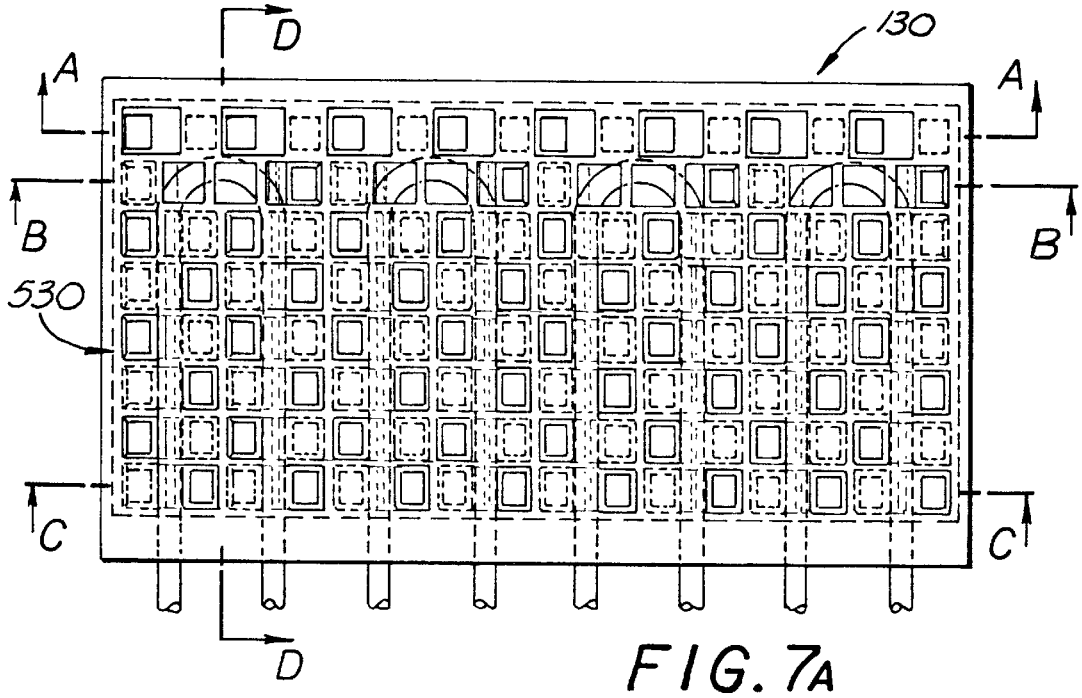
FIG. 7A is a more detailed illustrative embodiment of the TES module implemented in refrigeration systems of FIGS. 2 and 4A.

More specifically, FIGS. 7A provides a detailed view of an embodiment of evaporation unit (e.g., first evaporation unit 130) having TES module 530. Various cross-sectional views of the evaporation unit along lines A—A, B—B, C—C and D—D are shown in FIGS. 7B, 7C, 7D and 7E, respectively.

Figure 7B:
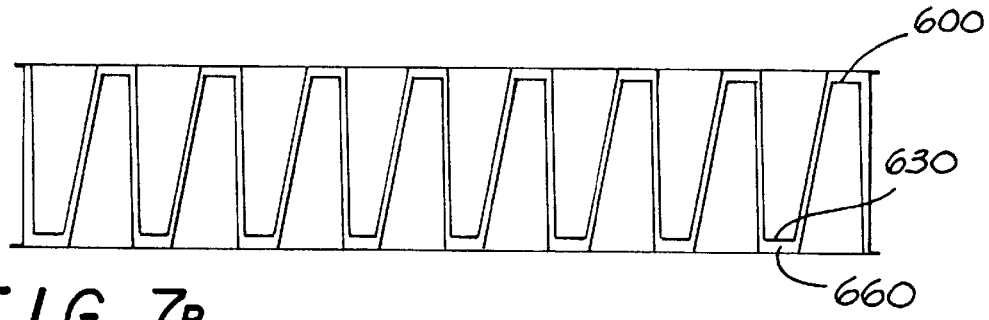
FIGS. 7B–7E are illustrative cross-sectional views of the TES module of FIG. 7A taken along lines A—A, B—B, C—C and D—D, respectively.

Referring now to FIG. 7B, a cross-sectional view (along lines A—A and perpendicular to a layout of evaporation tube 520) of an embodiment of TES module 530 of FIG. 7A is illustrated. As shown, this portion of TES module 530 is not in a region having any segment of evaporation tube 520 of evaporation unit. Thus, the array of protrusions formed by the second sheet 630 of TES module 530 interlock with cavities associated with the first sheet 600. This leaves a well-defined passage 660 for the thermal coupling solution to flow between sheets 600 and 630.

Figure 7C:
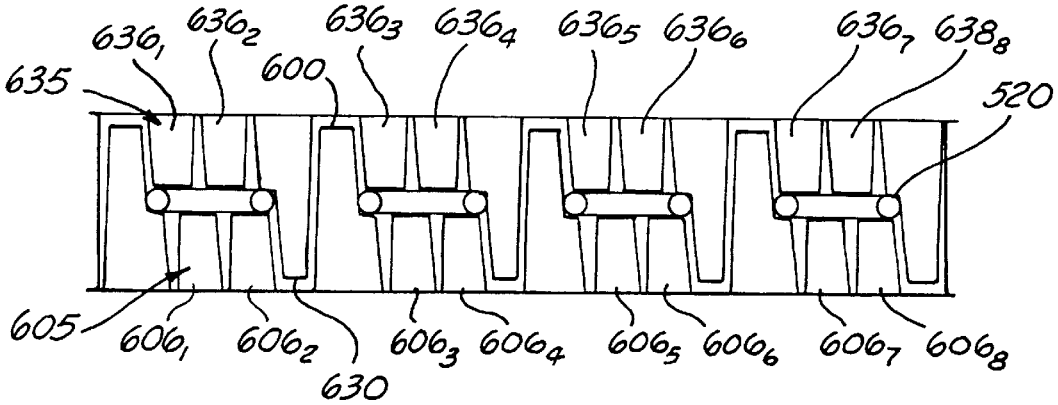

Referring to FIG. 7C, a cross-sectional view (along lines B—B) of the embodiment of TES module 530 of FIG. 7A is illustrated. Herein, the sizing and/or positioning of various protrusions associated with the first and second sheets 600 and 630 of TES module 530 is influenced by the presence or absence of segments of evaporation tube 520. In particular, the protrusions associated with the first and second sheets 600 and 630 usually is made of material which is more flexible than the material forming evaporation tube 520. Thus, a few protrusions $\mathbf{606}_1$–$\mathbf{606}_8$ associated with the array of protrusions 605 and protrusions $\mathbf{636}_1$–$\mathbf{636}_8$ associated with an array of protrusions 635 of second sheet 630 are compacted or adjusted to conform with evaporation tube 520. The passage 660 still remains between the first and second sheets 600 and 630. Alternatively, provisions can be made to ensure that the protrusions remain adjacent to evaporation tube, but at a distance so as to not contact a surface of evaporation tube 520.

Figure 7D:
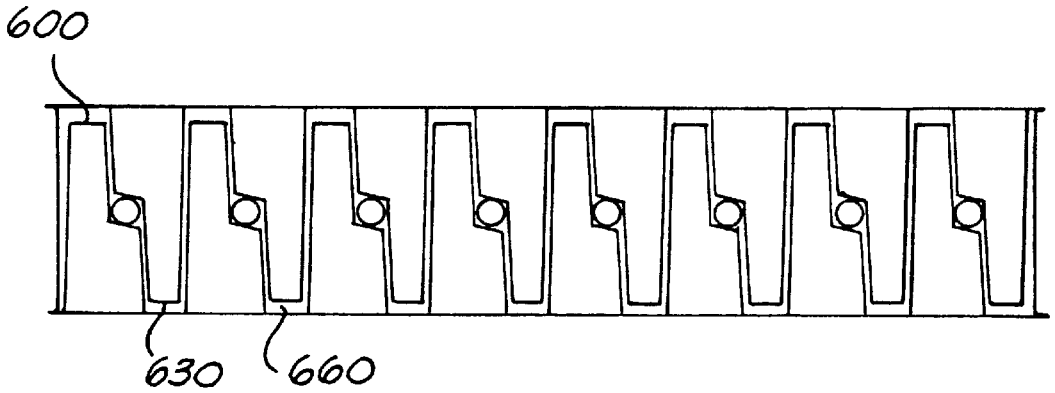
Figure 7E:
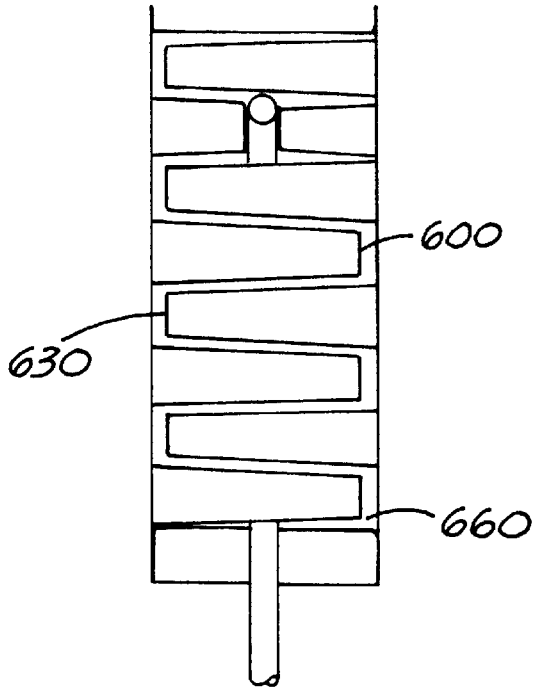

Referring to both FIGS. 7D and 7E, a cross-sectional view (along lines C—C and lines D—D) of the embodiment of TES module 530 of FIG. 7A is illustrated. As set forth in FIG. 7C, FIGS. 7D and 7E illustrate other cross-sectional views which indicate that the sizing and/or positioning of various protrusions associated with the first and second sheets 600 and 630 of TES module 530 are influenced by the presence or absence of segments of the evaporation tube 520. The passage 660 still remains between the first and second sheets 600 and 630.

Figure 8A:
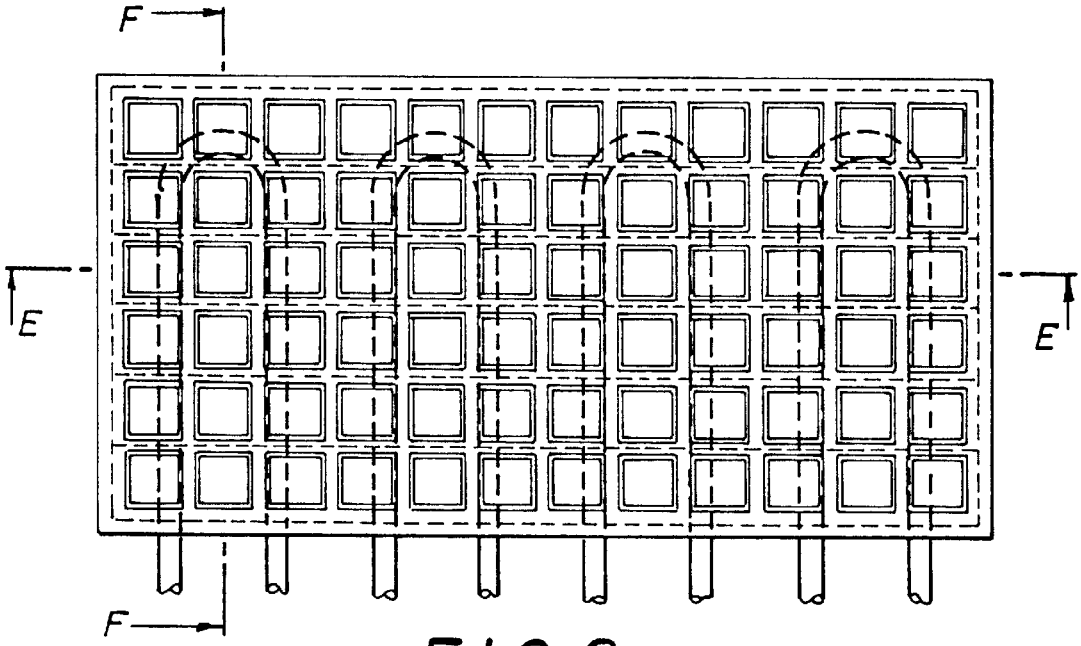
FIG. 8A is another detailed illustrative embodiment of the TES module implemented in refrigeration systems of FIGS. 2 and 4A.
Figure 8B:
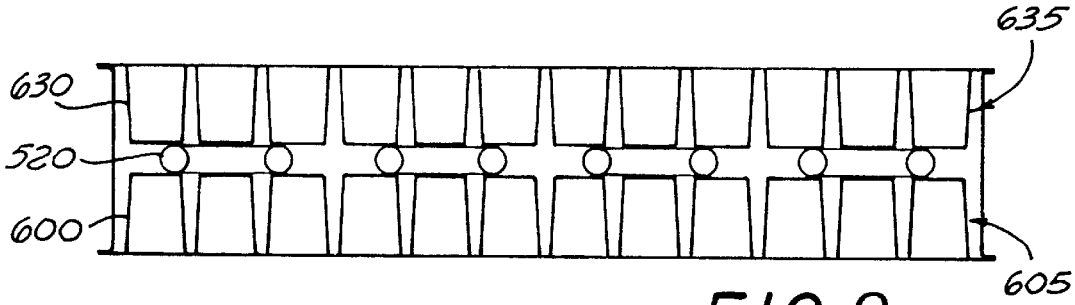
FIGS. 8B and 8C are illustrative cross-sectional views of the TES module of FIG. 8A taken along lines E—E and F—F, respectively.
Figure 8C:
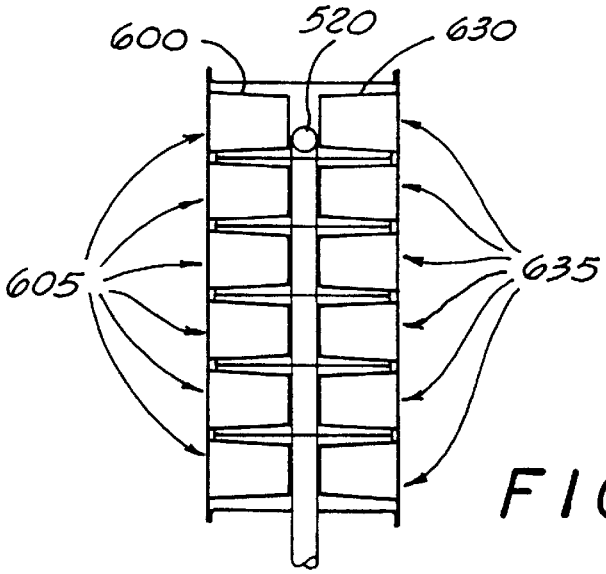

Referring to FIGS. 8A–8C, another embodiment of the TES module is shown along with cross-sectional views along lines E—E and F—F. In this embodiment, first sheet 600 includes array of protrusions 605 while second sheet 630 includes array of protrusions 635 as set forth in FIG. 8B. In contrast with the embodiment in FIGS. 6 and 7A–7E, these protrusions 605 and 635 are not sized to support an interlocking configuration. Instead, the protrusions 605 and 635 are sized to provide a separation spacing therebetween. The separation spacing is generally equivalent to the width of evaporation tube 520. As a result, the protrusions 605 and 635 are adjacent to (and in contact with) evaporation tube 520.

A further innovation involves adding a small amount of metal or other thermal conduction material to the TES material. Since water/ice has less than one percent (1%) of the conductivity of copper or aluminum, the addition of small amounts of metal fibers will enhance heat transfer from the freezing TES material.

Because TES is very effective at stabilizing temperatures in a refrigeration system, the conventional means of using temperature change to control on-and-off cycling of condensing unit 210 of FIGS. 2 and 4A has limitations. This would require the TES material to fully melt before the TES module temperature is used to generate a signal to turn-on the condensing unit is initiated because TES material necessarily has a lower melting temperature than the frost. Likewise, the TES material would be required to fully freeze before signaling the condensing unit to turn-off.

With respect to the present invention, a small reserve of frozen TES material is maintained by a "degree of freeze indicator" which may include a sensor that detects a change of dimension, volume or any other characteristic associated with the TES modules when the TES material freezes. There are many techniques for the degree of freeze indicator to detect characteristic changes. One technique is to construct containment vessel 540 of rigid material and incorporate some gas therein. A change volume can be calculated by the indicator measuring the pressure within containment vessel 540. A second technique is to construct containment vessel 540 of flexible material (or even only a localized area) and subsequently incorporating a degree of freeze indicator that can measure the dimension or change in dimension (i.e., deflection or inflection) of that material. The use of this degree of freeze indicator eliminates the need (and cost) of a conventional thermostat.

2. Control Protocol

The multi-stage refrigeration systems operate in accordance with a control protocol which is designed to minimize losses associated with on-and-off cycling of the condensing unit 210 and to maintain close temperature control in both sections 110 and 120 of refrigeration unit 100 of FIG. 1. This protocol also accommodates simple and thermally efficient defrosting of the evaporation unit located in the section 110 of refrigeration unit 100.

It has been realized that cycling losses in conventional refrigeration units constitute a substantial percentage of total energy consumption. Typically, this percentage ranges from five percent (5%) to as high as fifteen percent (15%) of the total energy consumed. These cycling losses may be incurred during the transitory start-up period of the condensing unit because the compressor of the condensing unit needs to operate for some time before steady-state operating pressures and temperatures are reached. Operations performed before reaching steady-state are less efficient than if performed during steady-state.

In addition, the cycling losses may be incurred during a thermal siphoning condition as experienced by the multi-stage refrigeration system of FIG. 2. A "thermal siphoning" condition is where refrigerant vapor flows back into an evaporation unit when the condensing unit is turned off. This refrigerant vapor condenses and deposits heat in the evaporation unit which increases the total system heat load associated with the evaporation unit. This additional heat load causes a reduction in system efficiency. It is contemplated that no thermal siphoning condition is present for the multi-stage refrigeration system of FIG. 4A due to the nature of the check valves.

Figure 9:
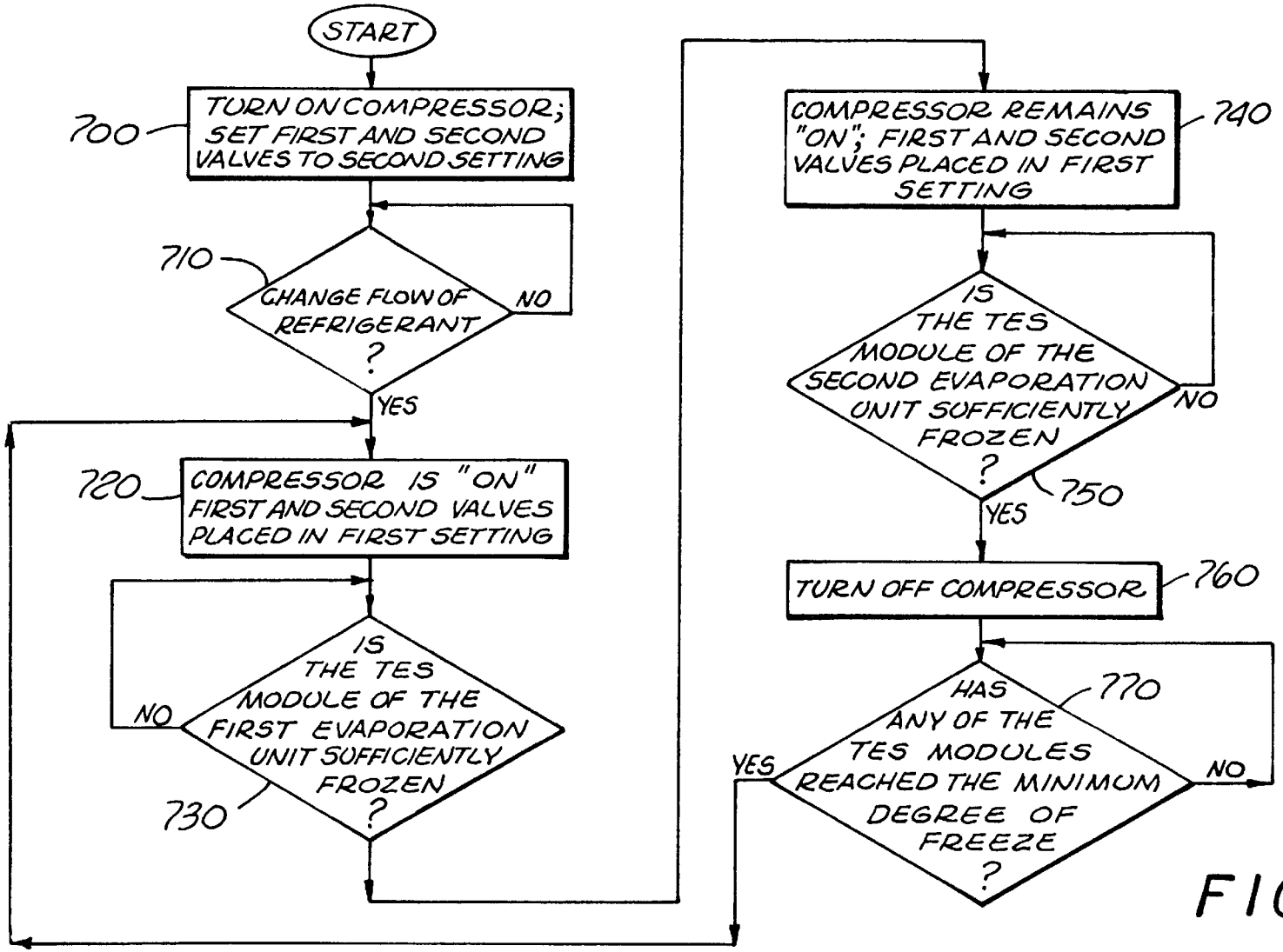
FIG. 9 is an illustrative flowchart of the operations of the multi-stage refrigeration system during a regular operation cycle.

Referring now to FIGS. 2 and 9 and Table 2, the control protocol associated with the multi-stage refrigeration system of FIG. 2 minimizes the start-up transient and thermal siphoning losses described above by initiating cooling with the second (higher temperature) evaporation unit; namely, an evaporation unit associated with the fresh food section. This is accomplished by turning on the compressor and placing the first and second valves 220 and 230 in the second setting (Step 700). As a result, refrigerant is circulated between the condensing unit 210 and the second evaporation unit 170 is shown in FIG. 2. This minimizes the amount of time to reach steady-state.

Next, one or more degree of freeze indicators are used to control the flow of refrigerant through the first and second valves 220 and 230 into evaporation units 130 and 170 based on a measured degree of freeze of the TES modules located in evaporation units 130 and 170. For example, after a predetermined time period or after a selected amount of the TES module of second evaporation unit 170 has been frozen, first and second valves 220 and 230 are placed in the first setting where refrigerant is circulated between first evaporation unit 130 and condensing unit 210 (Steps 710 and 720).

When the TES module in first evaporation unit 130 is determined to be sufficiently frozen as detected by one or more degree of freeze indicators of the first evaporation unit 130 (e.g., one or more position sensors), first and second valves 220 and 230 are again placed in the second setting where refrigerant is circulated between second evaporation unit 170 and condensing unit 210 (Steps 730 and 740). Thereafter, when the TES module in second evaporation unit 170 is determined to be sufficiently frozen, compressor 211 of condensing unit 210 is turned off and first and second values 220 and 230 remain in the first setting (Steps 750 and 760).

When either of the TES modules reach a "minimum degree of freeze" which represents a predetermined amount of TES material being frozen (Step 770), compressor 211 of condensing unit 210 is turned on and repeats the sequence described above and listed in Table 2. The completion of this cycle freezes the TES modules to a predetermined degree of freeze, as determined by the degree of freeze indicator(s), to generally maintain a stable, constant temperature. By maintaining sections of a refrigeration unit at stable temperatures, the degradation rate of the food is significantly improved (i.e., slower).

TABLE 2

State of Valves and Compressor for the Regular Cycle

| Regular Cycle stages (in execution sequence) | First Valve | Second Valve | Compressor | Stage complete when: |
|---|---|---|---|---|
| Compressor start, initiated by degree of freeze indicator(s) reaching minimum in one TES mechanism | 1-off, 2-on | 1-off, 2-on | on | Start up transient ended |
| First evaporation unit on | 1-on, 2-off | 1-on, 2-off | on | TES in evaporator #2 frozen |
| Second evaporation unit on | 1-off, 2-on | 1-off, 2-on | on | TES in evaporator #1 frozen |
| Compressor shut down | 1-off, 2-on | 1-off, 2-on | off | Condensing unit power off |
| Quiescent state, cooling by TES | 1-off, 2-on | 1-off, 2-on | off | Cooling until sensor detects that a TES module has reached a minimum degree of freeze |

For the regular cycle presented in Table 2, the use a condensing unit smaller than the size required for a conventional single-stage refrigeration system is permitted. This smaller condensing unit is less costly as well as produces less noise and occupies less volume than the larger or multiple condensing units associated with conventional refrigeration systems. Also, the implementation of TES modules can provide enhanced cooling.

Figure 10:
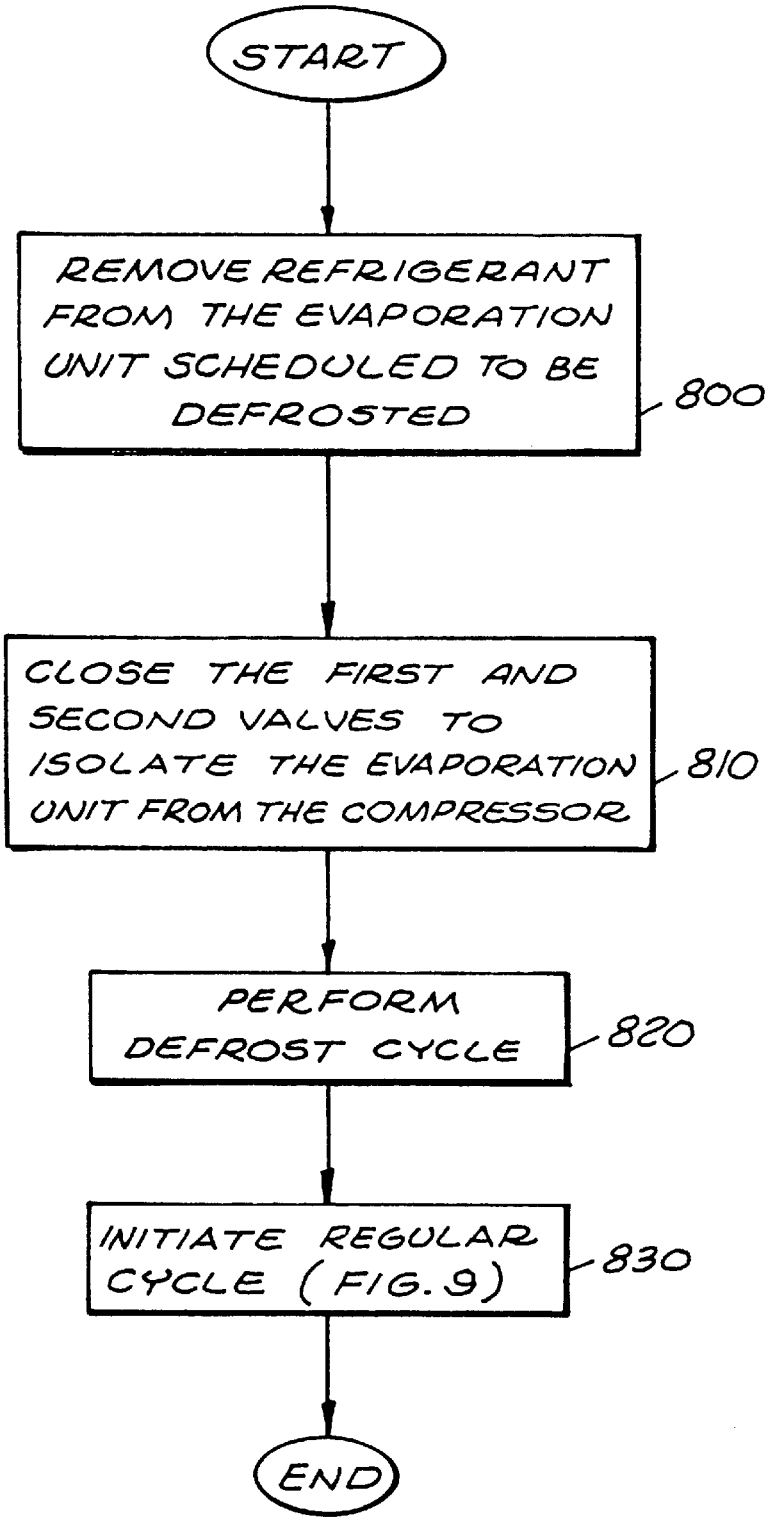
FIG. 10 is an illustrative flowchart of the operations of the multi-stage refrigeration system during a defrost cycle.

Referring now to FIG. 2, FIG. 10 and Table 3, an illustrative embodiment of the control protocol used to support an energy efficient defrost cycle for the multi-stage refrigeration system of FIG. 2 is shown. The defrost cycle is performed prior to the regular cycle. In addition, the defrost cycle is not performed immediately prior to the quiescent state because refrigerant is removed from evaporation tubes of the first evaporation unit.

For the defrost cycle, the compressor is turned on while the first valve is placed in the second setting and the second valve is placed in the first setting (Step 800). This causes refrigerant to be removed from the first evaporation unit, namely the evaporation tube 520 of FIG. 5. Next, the compressor is turned off and the second valve is placed in the second setting to avoid unwanted material from passing through the second valve (Step 810). As a result, evaporation tube 520 of FIG. 5 no longer acts as a heat pipe when heated by a heater as described by U.S. Pat. Nos. 4,756,164 and 4,712,387, both of which are incorporated by reference herewith. Thereafter, defrosting proceeds and when completed, the regular cycle of FIG. 9 is initiated (Steps 820 and 830).

TABLE 3

State of Valves and Compressor for the Defrost Cycle.

| Defrost cycle stages | First Valve | Second Valve | Compressor | Must be run prior to Regular cycle and not immediately prior to quiescent state because the first evaporation unit is left with no refrigerant |
|---|---|---|---|---|
| Defrost cycle initiation | 1-off, 2-on | 1-on, 2-off | on | Refrigerant is removed from the first evaporation unit |
| Defrost, (Frost removed by heater, heat from fresh food section, or other source) | 1-off, 2-on | 1-off, 2-on | off | Allow frost to melt from heat exchange surface. |

Referring back to FIGS. 4A–4C and Table 1, the control protocol of the multi-stage refrigeration system of FIG. 4A minimizes the start-up transient losses described above. This is accomplished by turning on the compressor and overridding the second and fourth valves 420 and 440. As a result, refrigerant is circulated between the condensing unit and the second evaporation unit 170 as shown in FIG. 4A. This minimizes the amount of time to reach steady-state.

Next, one or more degree of freeze indicators are used to control the flow of refrigerant through the second and fourth valves 420 and 440 into evaporation units 130 and 170 based on a measured degree of freeze of the TES modules located in evaporation units 130 and 170. For example, after a predetermined time period or after a selected amount of the TES module of second evaporation unit 170 has been frozen, the second and fourth valves 420 and 440 operate as normal check valves and the first and third valves 410 and 430 are overridden so that refrigerant is now circulated between first evaporation unit 130 and the condensing unit.

When the TES module in first evaporation 130 unit is determined to be sufficiently frozen as detected by an degree of freeze indicator (e.g., one or more position sensors), the first and third valves 410 and 430 are again set to operate as normal check valves to prevent refrigerant flow while the second and fourth valves 420 and 440 are overridden so that refrigerant is circulated between second evaporation unit 170 and the condensing unit. Thereafter, when the TES module in second evaporation unit 170 is determined to be sufficiently frozen, the compressor of the condensing unit is turned off while all of the valves 410, 420, 430 and 440 return to their normal operations in preventing refrigerant flow.

When either of the TES modules reach a "minimum degree of freeze" which represents a predetermined amount of TES material being frozen, the compressor of the condensing unit is turned on and the sequence described above and listed in Table 1 is repeated.

With respect to undergoing a defrost cycle prior to the regular cycle as set forth in Table 1, the compressor is briefly turned on and whereupon the third valve 430 allows refrigerant to be removed from the evaporation tubes of the first evaporation unit 130 of FIG. 4A. Next, the compressor is turned off and the third valve returns to its normal check valve operations. As a result, evaporation tube 520 of FIG. 5 no longer acts as a heat pipe to allow defrosting to proceed. When defrosting has completed, the regular cycle is initiated.

While this invention has been described with reference to illustrative embodiments, this description is not intended to be construed in a limiting sense. Various modifications of the illustrative embodiments, as well as other embodiments of the invention apparent to persons skilled in the art to which the invention pertains, are deemed to lie within the spirit and scope of the invention. Thus, the invention should be measured in terms of the claims which follow.

What is claimed is:

1. An evaporation unit comprising:

a containment vessel;

an evaporator partially enclosed within the containment vessel, the evaporator formed with at least one evaporation tube; and an expandable container enclosed within the containment vessel, the expandable container placed adjacent to a portion of the at least one evaporation tube and including a first sheet including an array of closely spaced protrusions pre-formed prior to being enclosed within the containment vessel, the array of protrusions are situated adjacent and generally surrounding to the at least one evaporation tube, a substantially flat, first backing sheet sealed to a periphery of the first sheet, and a thermal energy storage (TES) material contained between the first sheet and the first backing sheet.

2. The evaporation unit of claim 1, wherein the containment vessel of the evaporation unit is filled with a thermal coupling solution.

3. The evaporation unit of claim 2, wherein the thermal coupling solution includes an aqueous solution supporting freely convecting heat transfer.

4. The evaporation unit of claim 1, wherein the TES material includes an aqueous solution.

5. The evaporation unit of claim 4, wherein the TES material further includes a small amount of metal to enhance thermal conductivity.

6. The evaporation unit of claim 1, wherein the evaporator includes a lower heat exchanger formed by a first segment of at least one evaporation tube, the lower heat exchanger including an inlet and an outlet for a refrigerant; and an upper heat exchanger formed by a second segment of the at least one evaporation tube, the upper heat exchanger is enclosed in the containment vessel to allow the expandable container to be placed adjacent to a portion of the upper heat exchanger.

7. The evaporation unit of claim 1, wherein the expandable container further includes a second sheet including an array of closely spaced protrusions, the array of protrusions of the second sheet are arranged to interlock with a plurality of cavities corresponding to protrusions of the first sheet; and a second backing sheet sealed to the second sheet to prevent leakage of the TES material contained between the second sheet and the second backing sheet.

8. The evaporation unit of claim 1, wherein each protrusion of the first sheet is tapered.

9. The evaporation unit of claim 1, wherein the expandable container further includes a second sheet including an array of closely spaced protrusions, the array of protrusions of the second sheet are arranged to leave a separation spacing from the first sheet.

10. An evaporation unit comprising:

an evaporator formed with at least one evaporation tube, the evaporator including an inlet and an outlet for a refrigerant; and an expandable container placed adjacent to a portion of the at least one evaporation tube of the evaporator, the expandable container including a first sheet including a plurality of protrusions having a cavity between each neighboring protrusion, the plurality of protrusions are situated adjacent to and generally surrounding a portion of the at least one evaporation tube, a substantially flat, first backing sheet sealed to a periphery of the first sheet, and a thermal energy storage (TES) material contained between the first sheet and the first backing sheet.

11. The evaporation unit of claim 10, wherein the evaporator comprises:

a lower heat exchanger formed by a first segment of at least one evaporation tube, the lower heat exchanger including the inlet and the outlet; and an upper heat exchanger formed by a second segment of the at least one evaporation tube, the upper heat exchanger adjacent to and in contact with the expandable container.

12. The evaporation unit of claim 11, wherein the TES material includes an aqueous solution.

13. The evaporation unit of claim 12, wherein the TES material further includes a small amount of metal to enhance thermal conductivity.

14. The evaporation unit of claim 10, wherein the expandable container includes a first sheet including a plurality of protrusions having a cavity between each neighboring protrusion, the plurality of protrusions are situated adjacent to the at least one evaporation tube; and a first backing sheet sealed to the first sheet to prevent leakage of the TES material.

15. The evaporation unit of claim 10, wherein the expandable container further includes a second sheet including a plurality of protrusions arranged complementary with the plurality of protrusions of the first sheet and situated adjacent to the at least one evaporation tube; and a second backing sheet sealed to the second sheet to prevent leakage of the TES material.

16. The evaporation unit of claim 15 further comprising a thermal coupling solution flowing between the first sheet and the second sheet of the expandable container.

17. The evaporation unit of claim 11 further comprising a containment vessel enclosing at least the upper heat exchanger, the containment vessel being filled with a thermal coupling solution.

18. The evaporation unit of claim 10, wherein the inlet is coupled to a first valve to receive the refrigerant from a condensing unit when the first valve is set to a first setting and the outlet is coupled to a second valve to return the refrigerant to the condensing unit.

19. The evaporation unit of claim 18, wherein both of the first and second valves operate in either (i) a normal setting to allow unidirectional flow of the refrigerant, or (ii) an override setting to allow bi-directional flow of the refrigerant therethrough.

20. The evaporation unit of claim 19 further comprising a complementary evaporator coupled to the condensing unit via a third valve and a fourth valve to receive and return the refrigerant to the condensing unit, the third and fourth valves operate in either (i) a normal setting to allow unidirectional flow of the refrigerant, or (ii) an override setting to allow bi-directional flow of the refrigerant therethrough.

21. The evaporation unit of claim 20, wherein the first, second, third and fourth valves are placed in a normal setting to provide passive cooling through melting of the TES material.

22. An evaporation unit comprising:

a containment vessel;

an evaporator placed within the containment vessel, the evaporator formed with at least one evaporation tube; and a first expandable container enclosed within the containment vessel, the first expandable container including a first sheet formed with a plurality of protrusions pre-formed prior to being enclosed within the containment vessel and a cavity between neighboring protrusions, the first sheet situated adjacent to the at least one evaporation tube, a second sheet sealed to the first sheet for providing an enclosed area to prevent leakage of thermal energy storage (TES) material, and the TES material contained between the enclosed area formed by the first sheet and the second sheet.

23. The evaporation unit of claim 22 further comprising a second expandable container within the containment vessel, the second expandable container including:

a third sheet formed with a plurality of protrusions to contain TES material and a cavity between neighboring protrusions, the third sheet situated adjacent to the at least one evaporation tube and the protrusions of the third sheet positioned in cavities of the first sheet to interweave the plurality of protrusions associated with the third sheet with the plurality of protrusions associated with the first sheet; and a fourth sheet sealed to the third sheet to provide an enclosed area to prevent leakage of the TES material in the second expandable container.

24. The evaporation unit of claim 22, wherein the containment vessel is filled with a thermal coupling solution.

* * * * *